US009441396B2

(12) United States Patent
Buchner et al.

(10) Patent No.: US 9,441,396 B2
(45) Date of Patent: Sep. 13, 2016

(54) KEY SAFE

(71) Applicants: Gideon Gerhardus Buchner, Pretoria (ZA); Louis Botha, Port Elizabeth (ZA)

(72) Inventors: Gideon Gerhardus Buchner, Pretoria (ZA); Louis Botha, Port Elizabeth (ZA)

( * ) Notice: Subject to any disclaimer, the term of this patent is extended or adjusted under 35 U.S.C. 154(b) by 0 days.

(21) Appl. No.: 14/769,040

(22) PCT Filed: Mar. 5, 2014

(86) PCT No.: PCT/ZA2014/000007
§ 371 (c)(1),
(2) Date: Aug. 19, 2015

(87) PCT Pub. No.: WO2014/153571
PCT Pub. Date: Sep. 25, 2014

(65) Prior Publication Data

US 2016/0002951 A1 Jan. 7, 2016

(30) Foreign Application Priority Data

Mar. 13, 2013 (ZA) ..... 2013/01880

(51) Int. Cl.
*G07F 17/00* (2006.01)
*E05B 19/00* (2006.01)
(Continued)

(52) U.S. Cl.
CPC ..... *E05B 19/0005* (2013.01); *E05G 1/02* (2013.01); *G07F 11/165* (2013.01); *G07F 11/54* (2013.01); *G07F 11/64* (2013.01); *G07F 17/0042* (2013.01); *E05G 2700/02* (2013.01)

(58) Field of Classification Search
CPC ... G07F 11/165; G07F 17/00; G07F 17/0042
USPC ..... 221/124, 210, 213, 123, 126; 700/236, 700/237
See application file for complete search history.

(56) References Cited

U.S. PATENT DOCUMENTS 4,812,985 A * 3/1989 Hambrick ..... G07F 17/00 221/9
5,143,193 A * 9/1992 Geraci ..... G07F 7/069 194/212

(Continued)

FOREIGN PATENT DOCUMENTS

| | | |
|---|---|---|
| FR | 2729066 | 12/1996 |
| WO | 9201273 | 1/1992 |
| WO | 2005096236 | 10/2005 |

OTHER PUBLICATIONS

International Search Report and Written Opinion in PCT Application No. PCT/ZA2014/000007 issued Aug. 22, 2014.

*Primary Examiner* — Timothy Waggoner
(74) *Attorney, Agent, or Firm* — Haugen Law Firm PLLP

(57) ABSTRACT

A key safe (10) includes a main container (14) defining an access port (20), an antechamber (16) and a primary hook (22) located within the antechamber (16). The antechamber (16) is movable between a first position in which a user is permitted access thereto and to the primary hook (22) from outside the main container (14) via the access port (20), and a second position in which the user is not permitted access to either the antechamber (16) or the primary hook (22) from outside the main container (14). The key safe (10) further includes a plurality of secondary hooks (26) located within the main container (14), which secondary hooks (26) are not directly accessible to a user. In use, transport means (18) transport keys between the primary hook (22) and a secondary hook (26) when the antechamber (16) is in the second position.

13 Claims, 9 Drawing Sheets

(51) Int. Cl.

| | |
|---|---|
| ***G07F 11/16*** | (2006.01) |
| ***G07F 11/54*** | (2006.01) |
| ***G07F 11/64*** | (2006.01) |
| ***E05G 1/02*** | (2006.01) |

(56) References Cited

U.S. PATENT DOCUMENTS 5,172,829 A * 12/1992 Dellicker, Jr. ..... G07F 17/10 221/124
5,212,649 A * 5/1993 Pelletier ..... G07F 17/0042 221/120
5,251,782 A * 10/1993 Crosby ..... G07F 17/0042 221/2
6,505,754 B1 * 1/2003 Kenny ..... G07F 17/0042 221/123
6,882,282 B1 * 4/2005 Lie-Nielsen ..... G07C 9/00103 235/375
7,987,020 B1 * 7/2011 Swinea, Jr. ..... G07F 11/52 700/236
2012/0226380 A1 * 9/2012 Stobbe ..... G07F 17/10 700/237

* cited by examiner

KEY SAFE

BACKGROUND

The present invention relates to a key safe for securely receiving, storing and dispensing keys.

Various safes for storing keys and other items are known. For instance:

WO 2005/096236 "The management of key usage" to Wilken et al describes a safe with an access port and keys secured to a continuous chain that runs between a pair of sprockets to align a key with the access port;

U.S. Pat. No. 5,172,829 "Automated key dispenser" to Dellicker describes a unit with a plurality of key holders for releasably securing keys, and means for a user to select a key to be released by the its key holder and transported by gravity to a dispensing hatch. U.S. Pat. No. 6,505,754 "Apparatus for automated key retrieval and deposit" to Kenny et al goes a step further to include a container for receiving keys returned by users;

U.S. Pat. No. 5,212,649 "Electronic robot key distributor" to Pelletier et al describes a safe with an access port and a cylinder located within the safe, the cylinder having compartments for storing keys and other valuables therein. The cylinder is rotatable and axially movable to align a selected compartment with the access port and permit access to the valuable contained therein to a user;

FR 2,613,411 to Fraysse describes a safe with an access port, a storage rack within the safe and means for conveying selected objects between its location on the storage rack and the access port; and US 2004/0069572 "Device for storing and transferring products in small packets" to Anke et al describes a storage unit with an access hatch, a cylindrical array of storage compartments and means for moving items between the access hatch and a selected storage compartment. U.S. Pat. No. 4,814,592 "Apparatus and method for storing and retrieving articles" to Bradt et al described a similar system for receiving, storing and dispensing videocassettes.

It is an object of the present invention to provide a safe that is specifically designed for receiving, storing and dispensing keys.

SUMMARY OF THE INVENTION

According to the present invention, a key safe includes:

a main container defining an access port;

an antechamber;

a primary hook located within the antechamber;

the antechamber being movable between a first position in which a user is permitted access thereto and to the primary hook from outside the main container via the access port, and a second position in which the user is not permitted access to either the antechamber or the primary hook from outside the main container;

a plurality of secondary hooks located within the main container, which secondary hooks are not directly accessible to a user; and means to transport keys between the primary hook and a secondary hook when the antechamber is in the second position.

Typically, the key safe further includes a sensor for sensing whether a key is located on the primary hook when the antechamber is in the first position.

Generally, the secondary hooks are arranged in circular arrays.

Preferably, the key safe includes at least two axially displaced circular arrays of secondary hooks.

Typically, the transport means comprises an arm movable along the longitudinal axis of the circular arrays and rotatable about such longitudinal axis.

Generally, the arm defines a notch near its free end for locating a keyring associated with a key to be transported thereby therein.

Preferably, the free end of the arm includes two fingers sufficiently spaced from each other to receive a secondary or a primary hook therebetween. And, the notch is defined by the fingers. Alternatively, the free end of each of the primary and secondary hooks includes two fingers sufficient spaced to receive the free end of the arm therebetween.

Typically, the antechamber is rotatable between the first and second positions.

Generally, the key safe further includes means for identifying a key, which means may be an RFID reader located either within the antechamber or within the main container.

Preferably, the key safe further includes a database for associating each key with the secondary hook on which it is stored.

Typically, the key safe further includes input means for a user to select a key to be dispensed from the key safe.

Generally, each secondary hook is not movable relative to the main container.

Preferably, the antechamber with primary hook, the secondary hooks and the transport means are connected to a frame sized to fit within the main container.

BRIEF DESCRIPTION OF THE DRAWINGS

The invention will now be described in more detail, by way of example only, with reference to the accompanying drawings in which.

DESCRIPTION OF A PREFERRED EMBODIMENT OF THE INVENTION

Figure 1:
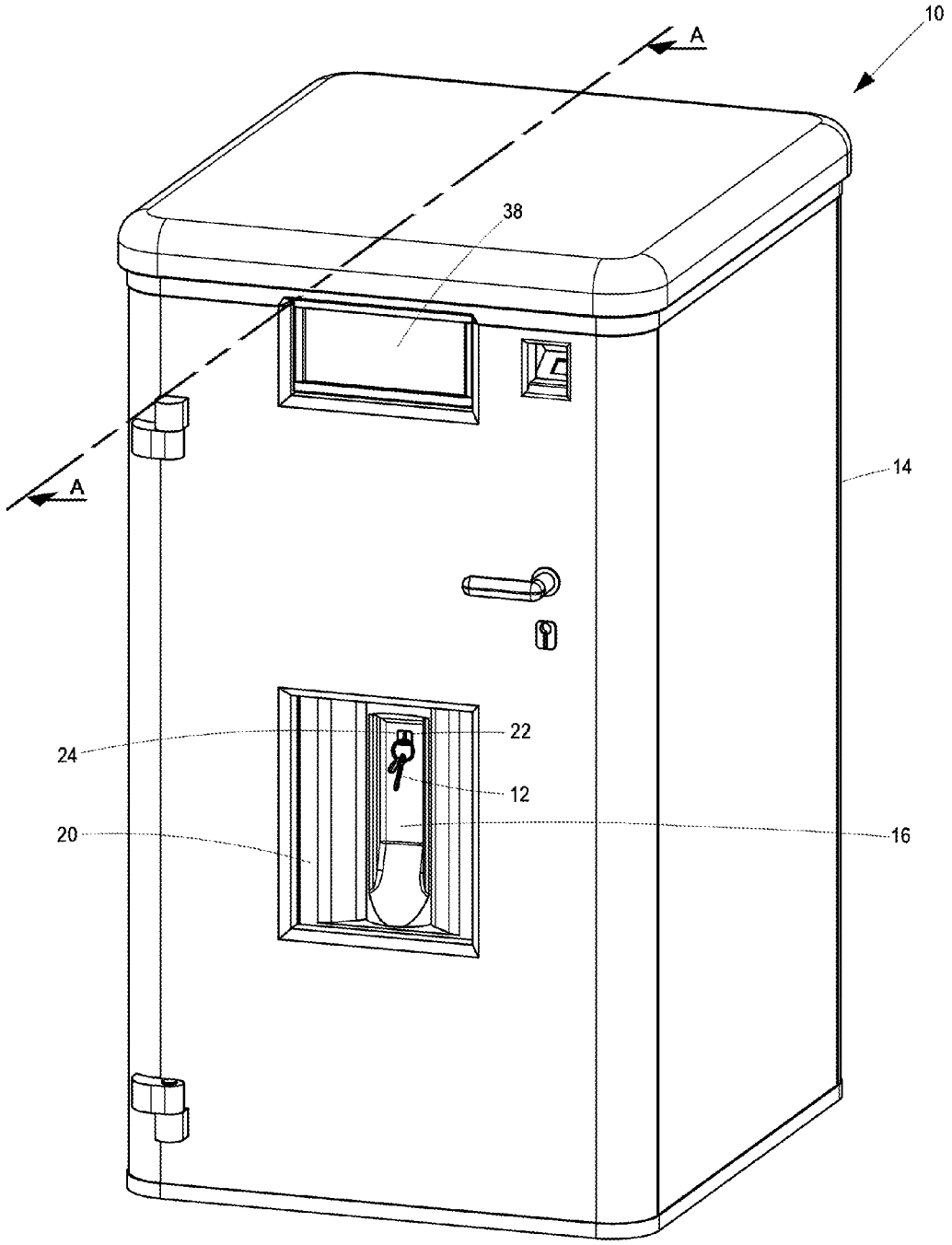
FIG. 1 is a perspective view of a key safe according the invention with a key located on a primary hook within an antechamber (in a first position)

With reference to FIGS. 1 to 9, a key safe 10 for receiving, storing, and dispensing keys 12 includes a main container 14, and antechamber 16 and transport means 18.

The main container 14 is similar to a standard steel safe but with the hingedly connected front panel defining an access port 20.

The access port 20 frames the antechamber 16, which houses a primary hook 22. The antechamber 16 is rotatable about a longitudinal axis between: (i) a first position in which a user (not shown) is permitted access to the antechamber 16 and primary hook 22 from outside the main container 14 via the access port 20; and (ii) a second position in which the user is not permitted access to either the antechamber 16 or the primary hook 22.

A sensor 24 is associated with the primary hook 22 for sensing whether a key 12 is located thereon when the antechamber 16 is in the first position.

Nine circular arrays of secondary hooks 26 are arranged inside the main container 14, spaced axially from each other. In use, the secondary hooks 26 are fixed/not movable relative to the main container 14.

Means 18 to transport keys 12 is located inside the main container 14. The transport means 18 comprises a central shaft 28 that extends along the longitudinal axis of the arrays of secondary hooks 26 and a transverse arm 30 that is movable along and rotatable about the shaft 28.

Figure 5:
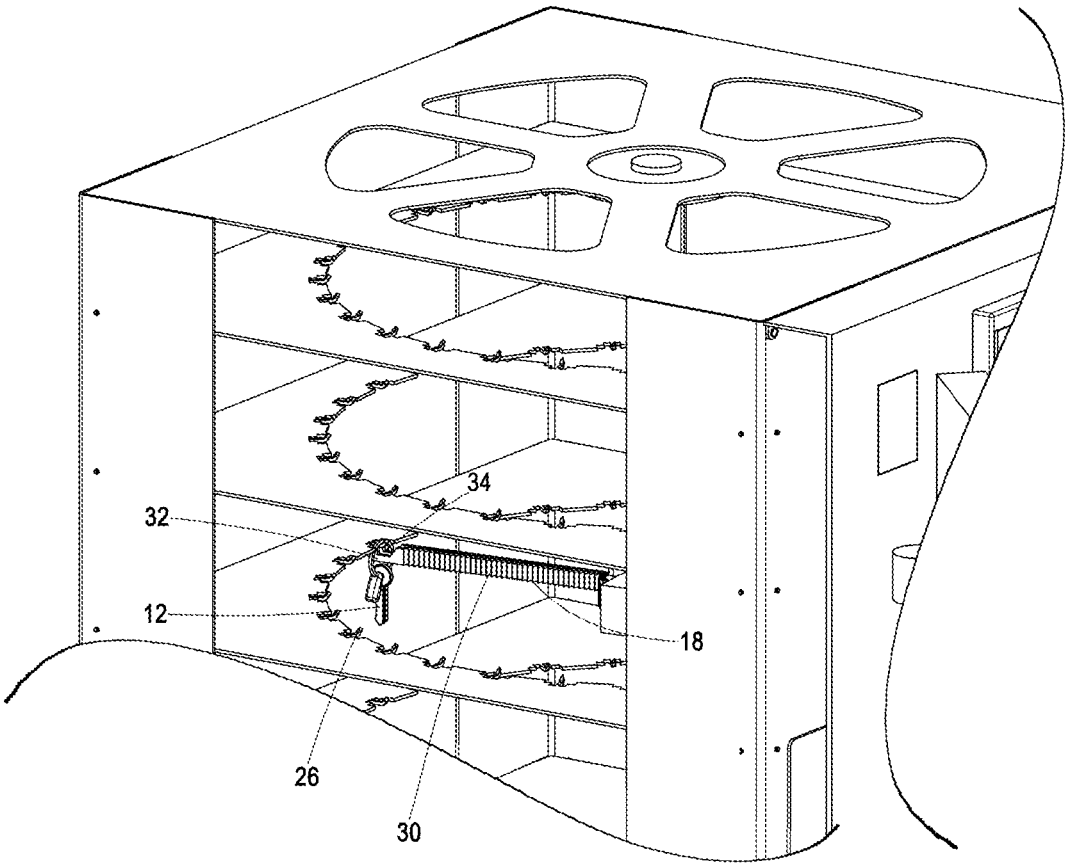
FIG. 5 is a perspective view of an enlarged portion of FIG. 4.
Figure 6:
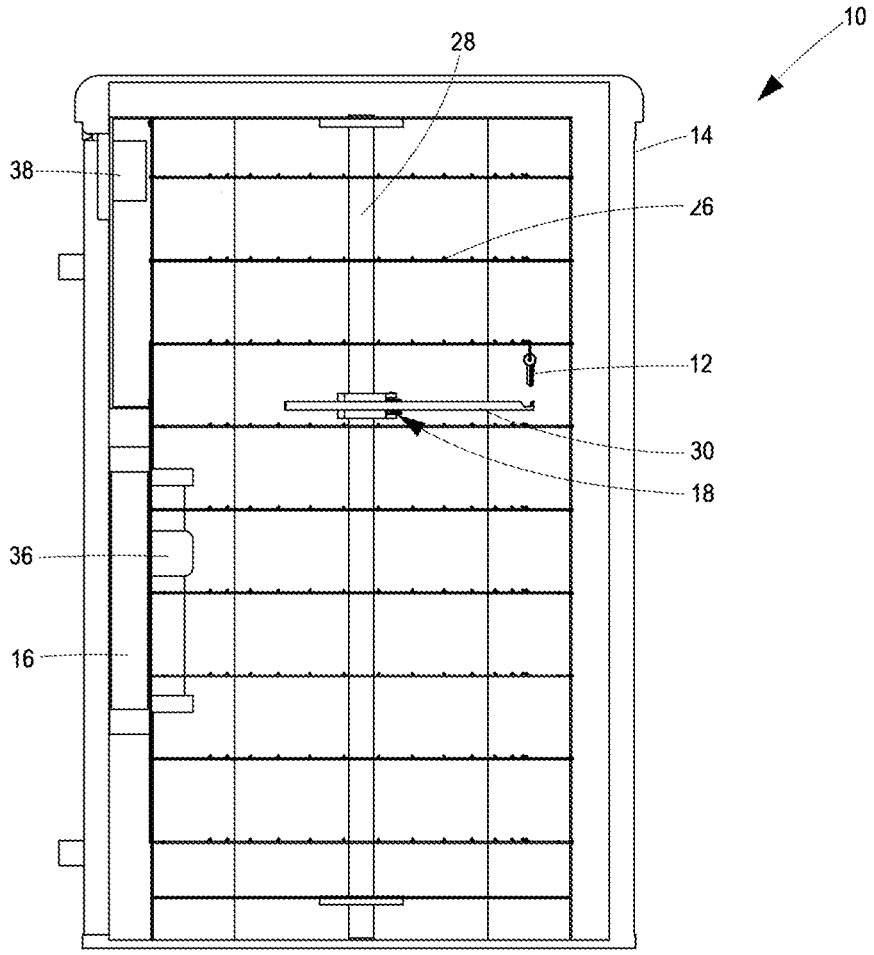
FIG. 6 is a cross sectional side view of the key safe in FIG. 1 along line A-A.
Figure 7:
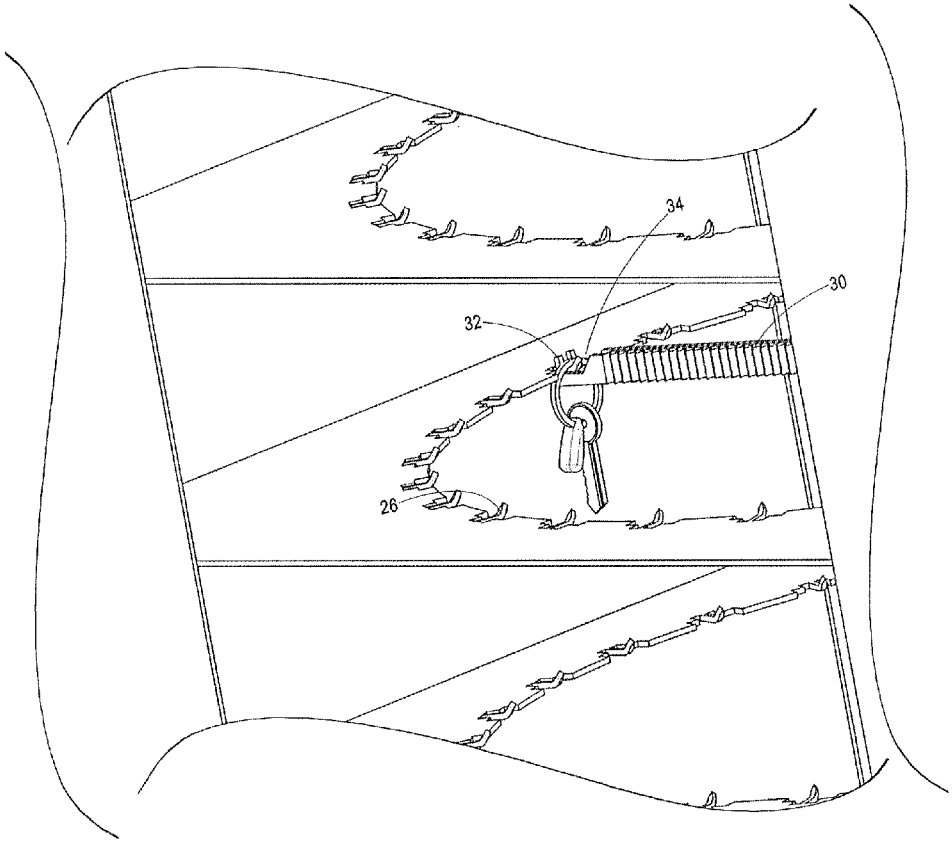
FIG. 7 is a perspective view of an enlarged portion of FIG. 5 in a first embodiment.
Figure 8:
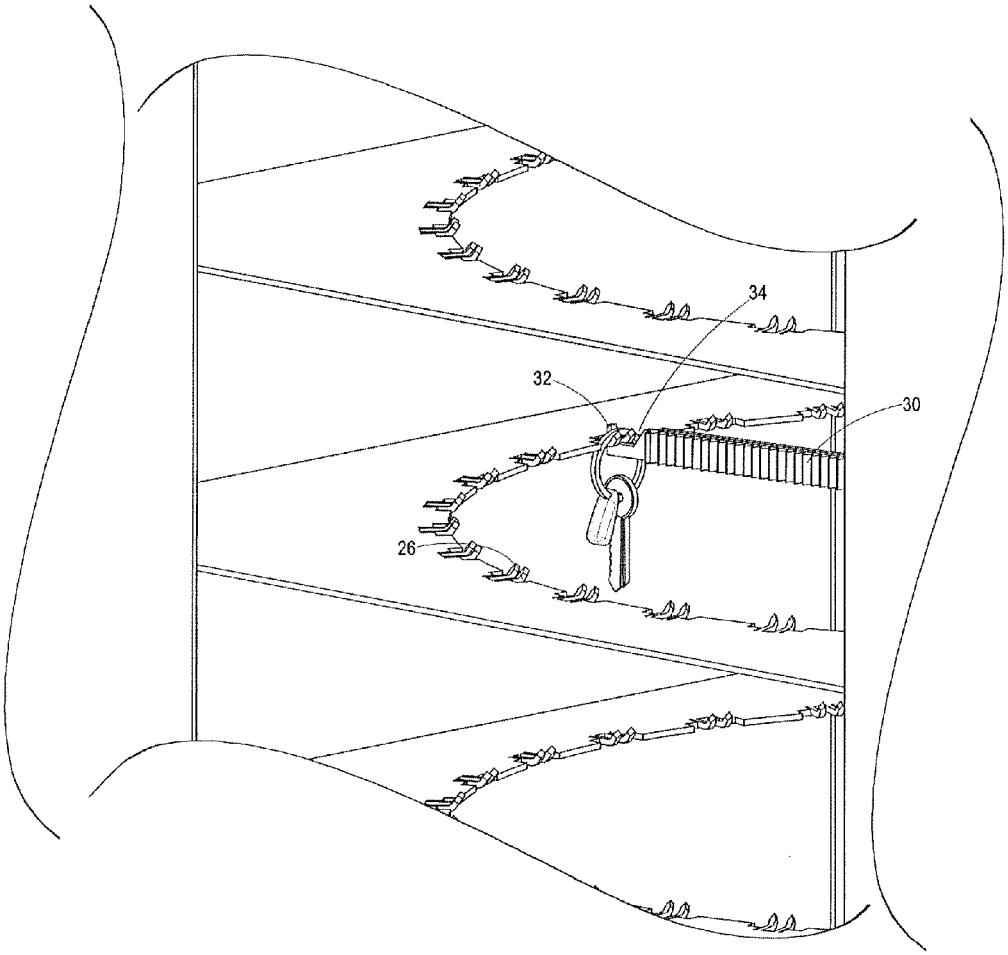
FIG. 8 is a perspective view of an enlarged portion of FIG. 5 in an alternative embodiment.
Figure 9:
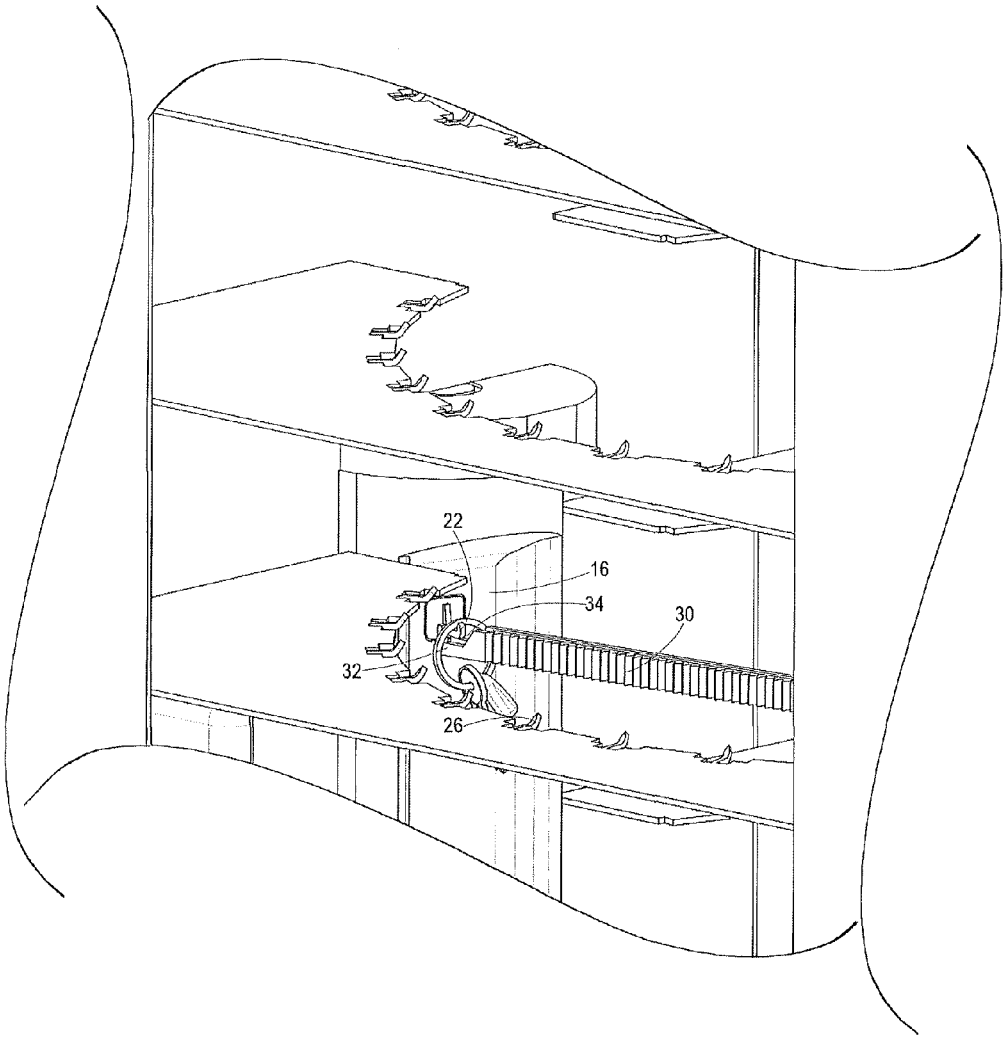
FIG. 9 is an enlarged perspective view of a portion of the key safe.

With specific reference to FIG. 5, the free end of the arm 30 terminates in a pair of fingers 32 spaced to receive the primary hook 22 or a secondary hook 26 therebetween. The fingers define a notch 34 on their operative upper surface near their free end, which notches 34 are sized and shaped to receive a keyring therein.

The transport means 18 can pick up a key 12 located on the primary hook 22 when the antechamber 16 is in the second position and deposit such key 12 on a secondary hook 26. Similarly, the transport means 18 can pick up the key 12 from the secondary hook 26 and deposit it on the primary hook 22 when the antechamber 16 is in the second position.

The antechamber 16 (with primary hook 22), secondary hooks 26 and transport means 18 are connected to a frame, which can be inserted into/removed from the main container 14 when the main container front panel is hingedly opened to permit access therein. With the frame inserted, the main container front panel is locked closed to prevent direct access to keys 12 secured on secondary hooks 26 within the main container 14 by a user located outside the main container 14 (irrespective whether the antechamber 16 is in the first or second position).

The key safe 10 further includes means 36 for identifying a key. The identifying means 36 is located in the main container 14 and is in the form of an RFID reader that communicates with an FRID tag on each key 12.

A database (not shown) stores the identity of each key 12 stored within the key safe 10 and associates it with a secondary hook 26 on which it hangs.

And, instructions to retrieve keys 12 from the key safe 10 are entered by a user (not shown) via input means 38 in the form of an LCD touch screen.

Figure 2:
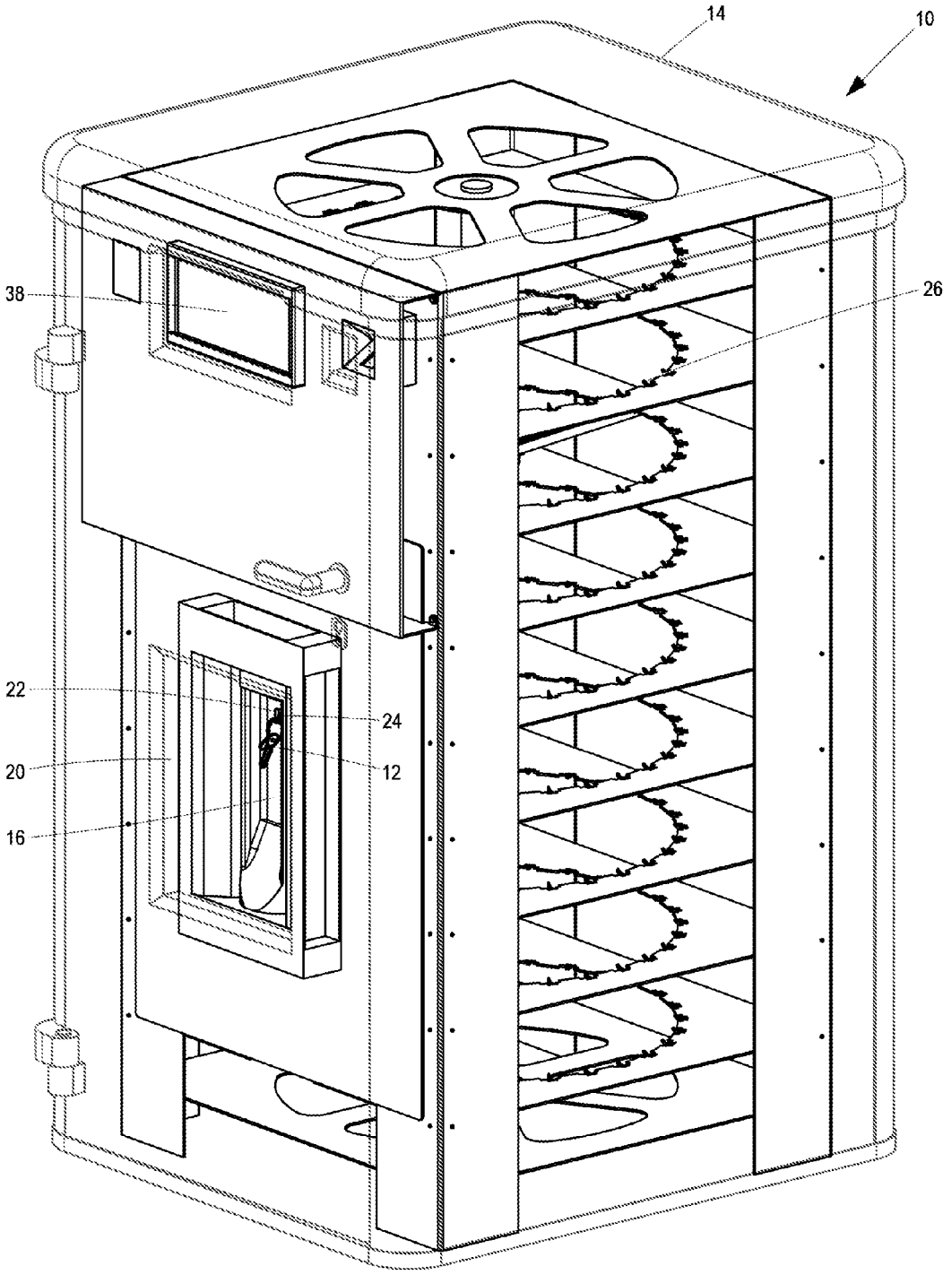
FIG. 2 is a perspective view of the key safe in FIG. 1 showing the interior of the safe.
Figure 3:
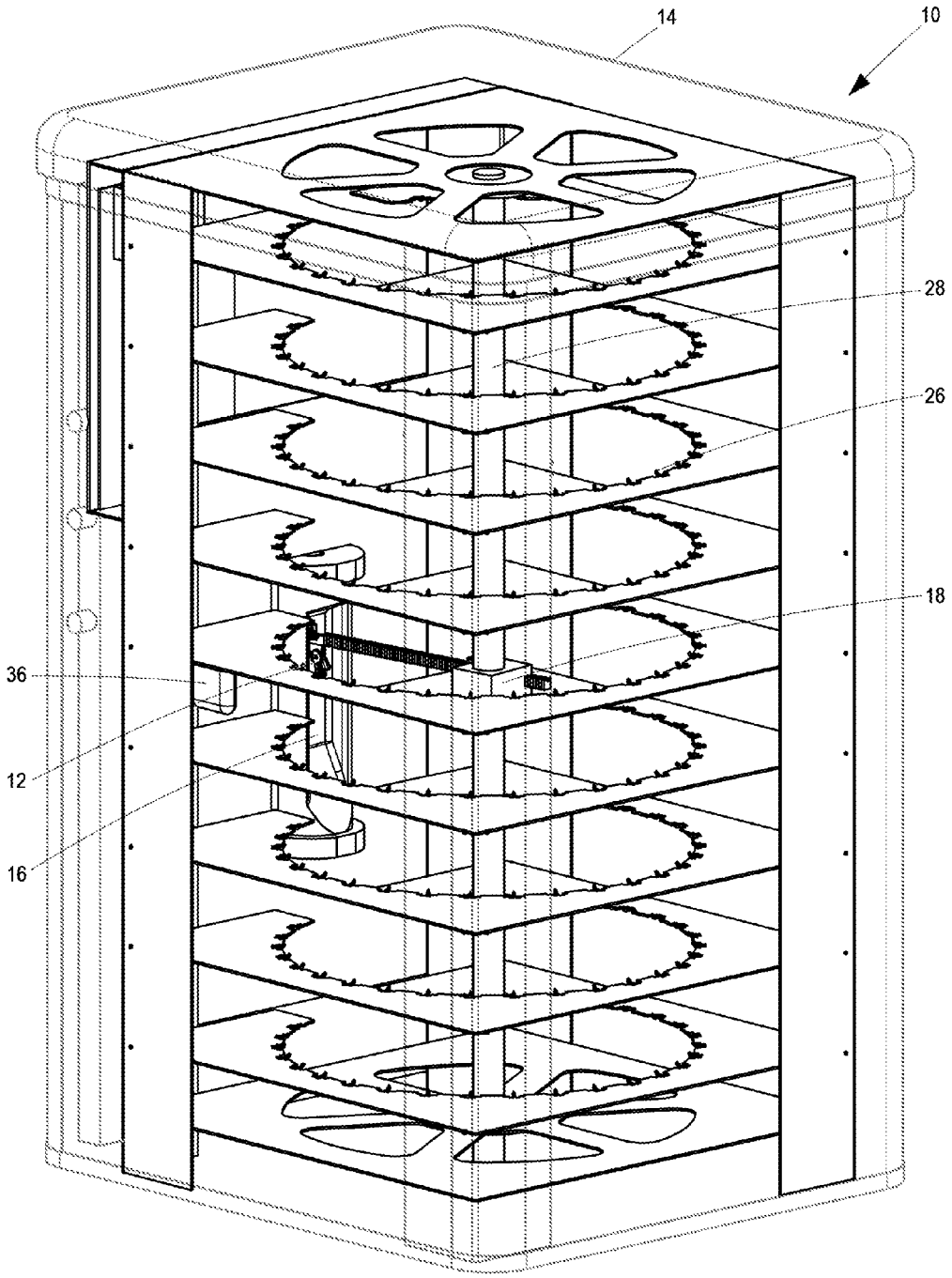
FIG. 3 is a perspective view of the key safe in FIG. 1 with the antechamber in a second position and the key being transported between the primary hook and a secondary hook in the main container.
Figure 4:
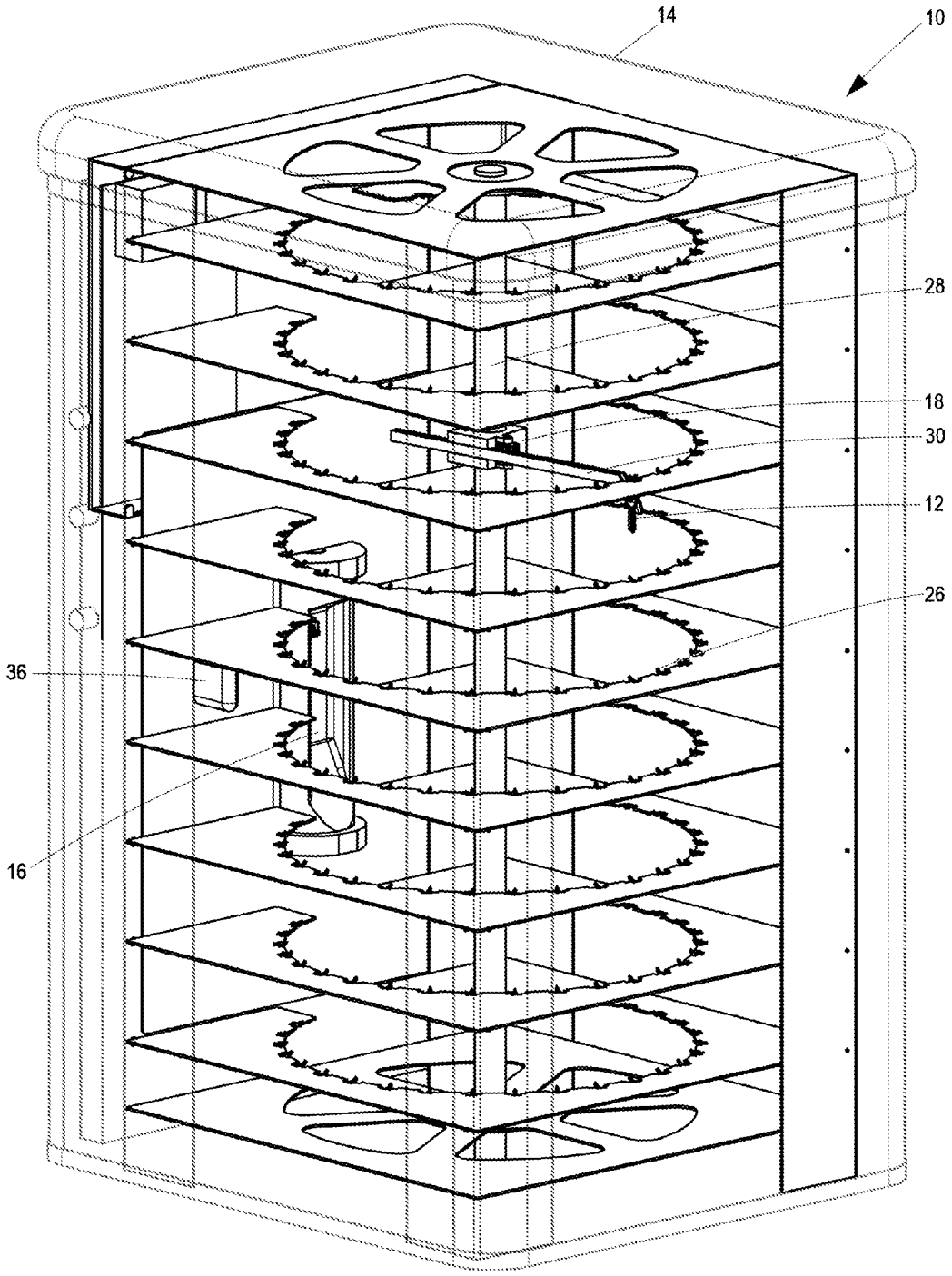
FIG. 4 is a perspective view of the transport means depositing a key on a secondary hook.

In use, and starting with FIGS. 1 and 2, a user (not shown) places a key 12 (with keyring and RFID tag) on the primary hook 22. The sensor 24 senses this, and causes the antechamber 16 to rotate from the first position to the second position. Turning to FIG. 3, the transport means 18 then rotates and moves along the central shaft 28 such that the fingers 34 flank the primary hook 22 and travel upwards to receive the key's 12 keyring within the notch 34 and raise the key 12 off the primary hook 22. The transport means 18 then moves the key 12 past the identifying means 36 to read the key's 12 unique identifier and send it to the database. The database associates the key 12 with a vacant secondary hook 26 and directs the transport means 18 (with key 12 hanging therefrom) towards the secondary hook 26 such that the fingers 34 flank the secondary hook 26 and travel downwards to deposit the key's 12 keyring thereon. The key 12 is now safely deposited within the key safe 10.

Should the user wish to retrieve a key 12, the user selects the key 12 using the input device 38. The antechamber 16 rotates from the first position to the second position and the database is interrogated to identify the secondary hook 26 associated with such key 12. The transport means 18 is then directed to approach the associated secondary hook 26 with its fingers 34 flanking the secondary hook 22 and travel upwards to receive the key's 12 keyring within the notch 34 and raise the key 12 off the secondary hook 26. The transport means 18 then moves the key 12 towards the primary hook 22 such that the fingers 34 flank the primary hook 22 and travels downwards to deposit the key's 12 keyring thereon. The antecamber 16 is then rotated back to the first position to permit the user access to the key 12.

It will be appreciated that although the hooks 22 and 26 and arm 30 have been described and illustrated in an arrangement whereby the fingers 32 of the arm 30 receive the hooks 22 and 26 therebetween, the arrangement can be reversed. In other words, each hook 22 and 26 could comprise a pair of fingers spaced from each other to receive the arm 30 therebetween.

It will also be appreciated that although the identifying means 36 has been described housed within the main container 14, it could alternatively be located within the antechamber 16.

The invention claimed is:

1. A key safe including:

a main container defining an access port;

an antechamber;

a primary hook located within the antechamber;

the antechamber being movable between a first position in which a user is permitted access thereto and to the primary hook from outside the main container via the access port, and a second position in which the user is not permitted access to either the antechamber or the primary hook from outside the main container;

a plurality of secondary hooks located within the main container, which secondary hooks are not directly accessible to a user; and an arm movable within the main container to transport keys between the primary hook and a secondary hook when the antechamber is in the second position, wherein said arm includes a free end, and wherein one of:

(i) the free end of the arm; or (ii) the secondary hooks and the primary hook, includes two fingers sufficiently spaced from each other to at least partially receive therebetween the other of:

(i) the free end of the arm; and (ii) the secondary hooks and the primary hook.

2. A key safe according to claim 1, further including a sensor for sensing whether a key is located on the primary hook when the antechamber is in the first position.

3. A key safe according to claim 2, wherein the secondary hooks are arranged in circular arrays.

4. A key safe according to claim 3, including at least two axially displaced circular arrays of secondary hooks.

5. A key safe according to claim 4, wherein the arm is movable along the longitudinal axis of the circular arrays and rotatable about such longitudinal axis.

6. A key safe according to claim 5, wherein the arm defines a notch near its free end for locating a keyring associated with a key to be transported thereby therein.

7. A key safe according to claim 1, wherein the antechamber is rotatable between the first and second positions.

8. A key safe according to claim 7, further including means for identifying a key.

9. A key safe according to claim 8, wherein the identifying means is an RFID reader located either within the antechamber or within the main container.

10. A key safe according to claim 9, further including a database for associating each key with the secondary hook on which it is stored.

11. A key safe according to claim 10, further including input means for a user to select a key to be dispensed from the key safe.

12. A key safe according to claim 11, wherein each secondary hook is not movable relative to the main container.

13. A key safe according to claim 12, wherein the antechamber with primary hook, the secondary hooks and the movable arm are connected to a frame sized to fit within the main container.

* * * * *